US008145083B2

(12) United States Patent
Carter, Jr. et al.

(10) Patent No.: US 8,145,083 B2
(45) Date of Patent: Mar. 27, 2012

(54) TONER CALIBRATION IN AN IMAGE FORMING DEVICE

(75) Inventors: Albert Munn Carter, Jr., Richmond, KY (US); Gary Allen Denton, Lexington, KY (US); John William Kietzman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 636 days.

(21) Appl. No.: 12/335,982

(22) Filed: Dec. 16, 2008

(65) Prior Publication Data

US 2010/0150589 A1 Jun. 17, 2010

(51) Int. Cl.
*G03G 15/00* (2006.01)

(52) U.S. Cl. ..... 399/49

(58) Field of Classification Search ..... 399/49, 399/74

See application file for complete search history.

(56) References Cited

U.S. PATENT DOCUMENTS 6,636,705 B2 * 10/2003 Fischer ..... 399/27

* cited by examiner

*Primary Examiner* — David Gray
*Assistant Examiner* — Gregory H Curran

(57) ABSTRACT

The present disclosure relates to a method, system and apparatus for calibrating toner measurement in an image forming device. A toner patch is deposited onto a control surface, the toner patch reflecting light in a plurality of wavelengths in the infrared spectrum. A toner patch sensor emits light at the plurality of wavelengths in the infrared spectrum onto the toner patch. The amount of incident light reflected from the toner patch at the plurality of wavelengths from the emitted light is measured, and used to generate measured signals indicative of the reflectivity of the toner patch. An operating parameter of the image forming device is adjusted based upon the measured signals.

28 Claims, 6 Drawing Sheets

TONER CALIBRATION IN AN IMAGE FORMING DEVICE

CROSS REFERENCES TO RELATED APPLICATIONS

Cross reference is made to copending application Ser. No. 11/771,121 and Ser. No. 11/871,245.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to image forming devices, and more particularly, to the sensing of toner density of deposited unfused toner in an image forming device.

2. Description of the Related Art

Electrostatically printed color images may be produced by depositing toners of various colors onto a recording media, such as a sheet of paper. Yellow, cyan, magenta and black toners in various proportions and combinations may be printed onto the recording media to produce a wide palette of printed colors. Each individual color of the producible palette may require a specific proportion and combination of toners. If the particular proportions of toner for a selected color cannot be repeatedly deposited on the printed media, then the printed color may not be consistent, and may vary in hue, chroma, and/or lightness from attempt to attempt of printing. The proportion of each toner color to be deposited may be based on the thickness of the toner layer of a given color. Therefore, controlling the printed colors, and ensuring reproducibility of the printed colors, may be achieved by controlling the toner layer thickness to ensure consistent color reproduction.

Toner patch sensors have therefore been used in printers and copiers to monitor the toner density of toner deposited onto a control surface in the printer, such as an intermediate transfer belt. Typically, such sensors may utilize a light source to illuminate a toner patch, and the reflectance of the incident light may be measured to indicate the thickness of the toner patch. The sensor may then provide a signal that the printer may use to adjust the toner density and control the print darkness. In color printers and copiers, toner patch sensors may be used to maintain the color balance and, in some cases, modify the gamma correction or halftone linearization as the electrophotographic process changes with the environment and aging effects. The reflectivity of the toner patch may not be constant over time due to differences in the size of the toner particles, and the accumulation of toner resin and extraparticulate particles on the control surface. As a result, the reflectivity of the toner patch may not accurately indicate the amount of toner on the control surface.

Some printers, such as the LEXMARK C522, available from Lexmark International, Inc., may use algorithms that rely on the absolute voltage signal levels from the toner patch sensor to adjust the electrophotographic operating parameters in an attempt to control color density. Other printers, like the LEXMARK C750, also available from Lexmark International, Inc., may use algorithms that use only the ratio of the signal level of the test toner patch to the signal level of the bare belt. However, the reflectivity of the bare belt may not be constant over time due to the accumulation of toner resin, wax and extraparticulate particles on the belt, and, therefore, the reflectivity of the belt may not be accurately predicted. This problem may degrade the accuracy of the toner patch sensor in printers that use reflection ratios to monitor and adjust color print densities. The mechanical positioning and orientation of toner patch sensor components may also affect the magnitudes of the toner patch signal for both the bare belt and the test patches. Variations in these mechanical factors from one printer to the next often lead to degradation in the accuracy of the color control system for both the ratio method and the absolute voltage method of toner patch signal color control.

Known printers typically use a toner patch sensor that employs a single infrared wavelength for the measurements of toner reflectivity, typically around 880 to 940 nm. The use of a single wavelength and its associated hardware limits the accuracy of the toner patch sensor and the resulting calibration of the printer, as variations in the reflectivity of the control surface, the size of the toner particles, the accumulation of toner resin and extraparticulate particles all affect the accuracy of the calibration.

SUMMARY OF THE INVENTION

In accord with the present invention, a method for calibrating an image forming device having a toner patch sensor that emits and detects light in the infrared spectrum includes depositing a toner patch onto a control surface, the toner patch reflecting light in a plurality of wavelengths in the infrared spectrum, emitting light at the plurality of wavelengths in the infrared spectrum with the toner patch sensor onto the toner patch, detecting the amount of incident light reflected from the toner patch at the plurality of wavelengths from the emitted light and measuring signals indicative of the reflectivity of the toner patch to generate measured signals, and adjusting an operating parameter of the image forming device based upon the measured signals.

Further in accord with the present invention, a system for calibrating an image forming device includes a light source capable of illuminating a toner patch deposited on a control surface, the toner patch reflecting light at a plurality of predetermined wavelengths in the infrared region, a detector capable of providing signals indicative of the reflectivity of the toner patch at the plurality of predetermined wavelengths, and a controller, including a processor in communication with the detector, wherein the processor is capable of receiving the signals from the detector indicative of the reflectivity of the toner patch at the plurality of predetermined wavelengths, and adjusting an operating parameter of the image forming device based on the signals from the detector.

Still further in accord with the present invention, an apparatus in an image forming device operated by parameters includes a light source capable of illuminating a toner patch deposited on a control surface, the toner patch reflecting light at a plurality of predetermined wavelengths in the infrared region, a detector capable of providing signals indicative of the reflectivity of the toner patch at the plurality of predetermined wavelengths, and a controller, including a processor in communication with the detector, wherein the processor is capable of receiving the signals from the detector indicative of the reflectivity of the toner patch at the plurality of predetermined wavelengths, and adjusting an operating parameter of the image forming device based on the signals from the detector.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
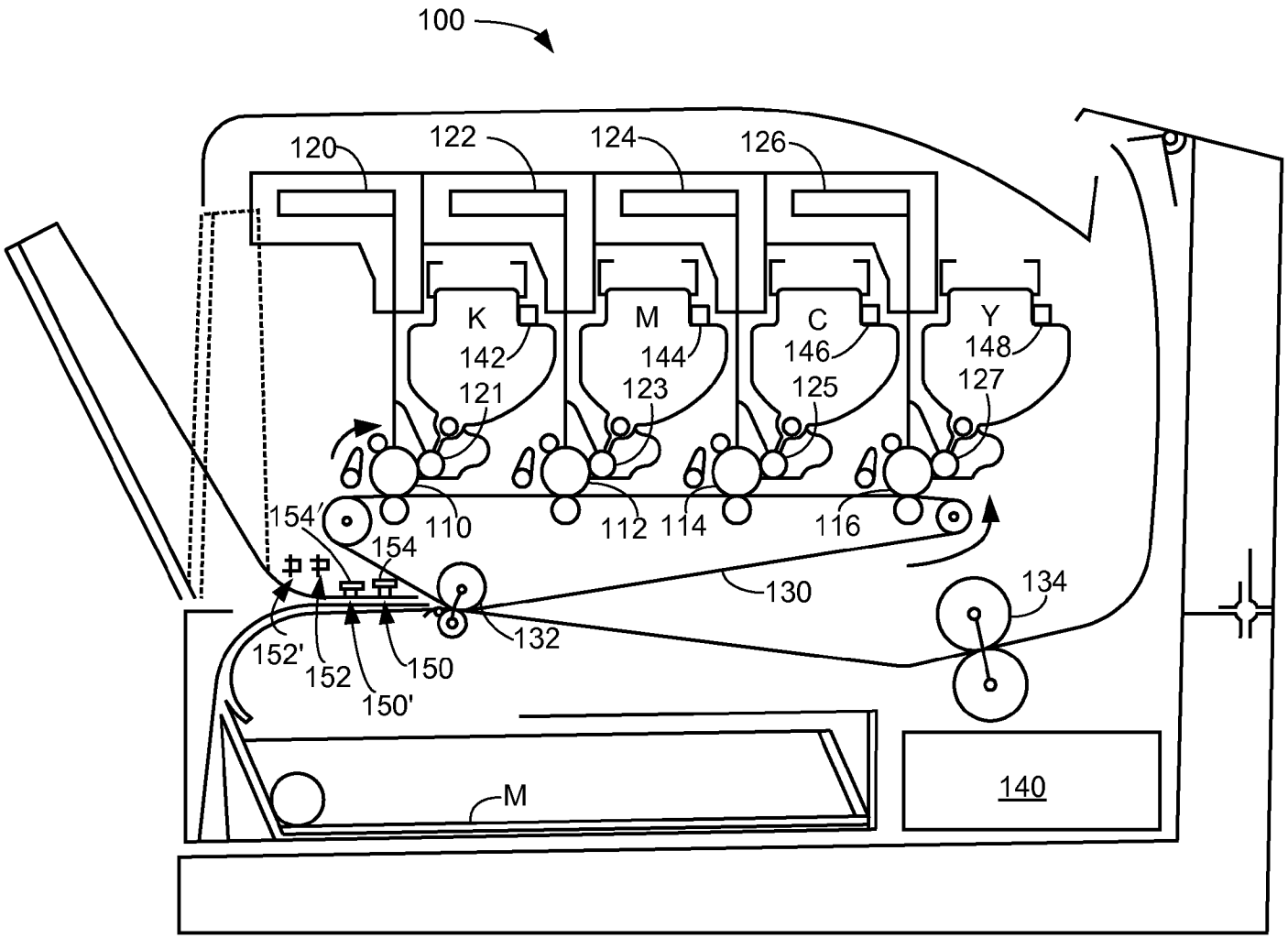
FIG. 1 is an illustration of an image forming device calibrated in accord with the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present invention generally relates to the measurement of deposited unfused toner density, and more particularly, to the calibration of such measurements, as made by a toner patch sensor. As alluded to above, toner patch sensors may be used in image forming devices wherein an image forming medium, such as ink or particulate toner, may be deposited on a sheet of paper or other material. In addition, the toner may be prepared according to a number of techniques. With regard to electrostatic printing, according to a first technique, a so-called "conventional toner" may be prepared from a toner resin that may be melt mixed with pigment and other additives. The melt mixed toner formulation may be crushed, pulverized, milled, etc., to provide fine particles. Additives may be incorporated onto the toner particle surfaces as an extra particulate additive. According to another technique, "chemically produced toner" may be prepared in which toner particles may be prepared by chemical processes such as aggregation or suspension rather than being abraded from much larger size materials by physical processes.

The image forming apparatus may include an electrophotographic device, copier, fax, all-in-one device or multi-functional device. As illustrated in FIG. 1, an exemplary image forming device 100 may include one or more photoconductive drums 110, 112, 114 and 116. Each drum may be charged via a charging device and then selectively discharged by, for example, a laser 120, 122, 124 and 126 to form a latent image thereon. Where multiple colors are utilized in a given image forming device, each latent image may correspond to a color component of the image to be printed.

Image forming media (toner) may be stored in one or more toner cartridges C, M, Y, K, representing, respectively, cyan, magenta, yellow and black toner. The individual toner cartridges may include a storage device 142, 144, 146, 148 for maintaining information regarding optical or physical characteristics of the toner composition stored therein. The storage devices 142, 144, 146, 148 may be in communication with a controller 140 located within the image forming device 100.

The toner may be transferred from a given cartridge to a sheet of media by depositing the toner onto a photoconductor via differential charging between the toner, a developer roller 121, 123, 125, 127 located within the cartridge, and the photoconductor 110, 112, 114 and 116. The image forming media may then be transferred from the photoconductor(s) to an intermediate transfer belt 130. It should be appreciated that at this point, where multiple colors are used, the various color component images are deposited over each other to form a single, multicolor image. The multicolor image may then be transferred by a transfer device 132 and then fused by a fuser 134 to a sheet of paper or other material M.

The image forming device 100 herein may include a closed-loop control system incorporating the controller 140 and one or more toner patch sensors 150 to maintain the proportions of image forming media that may be deposited during the image developing process, i.e., during printing. This may eliminate, or at least reduce, color shifts in printed images. In an exemplary control system, the toner layer thickness may be determined based on a light signal reflected by a printed test pattern. For example, a light source 152 may be used to illuminate solid and grayscale printed patterns, or patches, of the four toners, i.e., yellow, cyan, magenta, and black, printed on a control surface, which may include the intermediate transfer belt 130. However, it should be appreciated that other control surfaces may be utilized herein. According to the present invention, the light source 152 may be a single light emitting source, such as an LED, emitting light at two different wavelengths which are, in the preferred embodiment, 880 nm and 940 nm. Alternatively, the light source 152 could emit light at a single wavelength, for example, 880 nm, while a second light source 152' could then be employed to emit light at the second wavelength, for example, 940 nm. The reflected light signal may then be measured using a photodetector or other optical sensor 154, which may provide an indication of the deposited toner layer density or thickness. In the preferred embodiment, the sensor 154 is a single unit capable of detecting a range of infrared wavelengths, i.e., the light emitted by the first and second light sources 152, 152', at 880 nm and 940 nm. It will be appreciated that a second sensor 154' could also be employed if the first sensor 154 was not able to detect the full range of infrared wavelengths emitted by the first and second light sources 152, 152'.

One exemplary device herein for monitoring toner density or thickness on an unfused image is the toner patch sensor (TPS) as described in U.S. Pat. No. 6,628,398, whose teachings are incorporated by reference. Accordingly, an infrared light signal reflected by a printed toner layer or test pattern may therefore be generally related to the infrared reflectivity of the toner pigment and to the printed density or toner layer thickness. The TPS may therefore utilize a test patch in combination with a photodiode which may be configured to provide three different scenarios: (1) direct illumination with indirect detection; (2) indirect illumination and detection; and (3) diffuse illumination with direct detection. Density control may therefore be achieved that is substantially independent of the control surface roughness.

This, then, may facilitate toner layer thickness control as described more fully below. Such improved toner layer thickness control may therefore lead to improved ability to accurately and repeatedly produce colors of an image developed on a recording media, e.g., a printed image. However, over time, and from one printer to the next, parameters such as light source voltage, age, temperature, sensor distance to the control surface, the angle of the sensor relative to the belt, and light source or detector positioning within the sensor may affect the outcome of the toner patch sensor measurement. Accordingly, the readings obtained by the detector may vary, thus affecting the accuracy of adjustment of the operating conditions.

Image forming media (e.g., toner) to be measured for density or thickness may be placed on a control surface that may include the intermediate transfer belt described above. Toner patches, i.e., solid and grayscale toner test patterns, may be printed on the control surface and the control surface may be impinged with light from the light source 152, 152'. At least a portion of the infrared light may be reflected by the toner patches and collected by the sensor 154, 154'. The detector 154, 154' may then provide a signal of a given voltage corresponding to the reflectivity of the toner patch to the processor (see below in connection with FIG. 2).

The toner layer density and/or thickness may then be determined from the strength of the reflected signal from the toner patches. An exemplary relationship for determining the mass density of the toner, i.e., the amount or mass of toner deposited over a given area (e.g., mg/cm$^2$), is illustrated below and is disclosed in copending U.S. patent application Ser. No. 11/771,121, whose teachings are incorporated herein:

$$R_{patch}=R_{sat}+(R_{under}-R_{sat})*e^{-kx}$$

wherein $R_{patch}$ may be a signal indicative of reflectivity of the toner patch, $R_{sat}$ may be a signal indicative of reflectivity of a toner layer thick enough that the signal indicative of reflectivity of the toner is independent of the underlying surface, $R_{under}$ may be a signal indicative of reflectivity of the underlying surface, k is a coefficient indicative of the hiding power of the toner, and x is the mass density of the toner (mg/cm$^2$). The underlying surface may be a control surface, $R_{control}$, such as an intermediate transfer belt, or another toner layer upon which the toner is deposited. As alluded to above, the signals indicative of reflectivity may be electrical signals, such as voltage or optical current signals.

The above may also be expressed in terms of the reflectivity ratio, i.e., the ratio of the signal indicative of reflectivity of a given toner patch or underlying surface to the signal indicative of the reflectivity of the underlying surface, resulting in the following equation.

$$RR_{patch}=RR_{sat}+(RR_{under}-RR_{sat})*e^{-kx},$$

wherein the reflectivity ratios may be represented by the following:

$$RR_{patch}=\frac{R_{patch}}{R_{belt}},\ RR_{sat}=\frac{R_{sat}}{R_{belt}},\ RR_{under}=\frac{R_{under}}{R_{belt}}.$$

Figure 2:
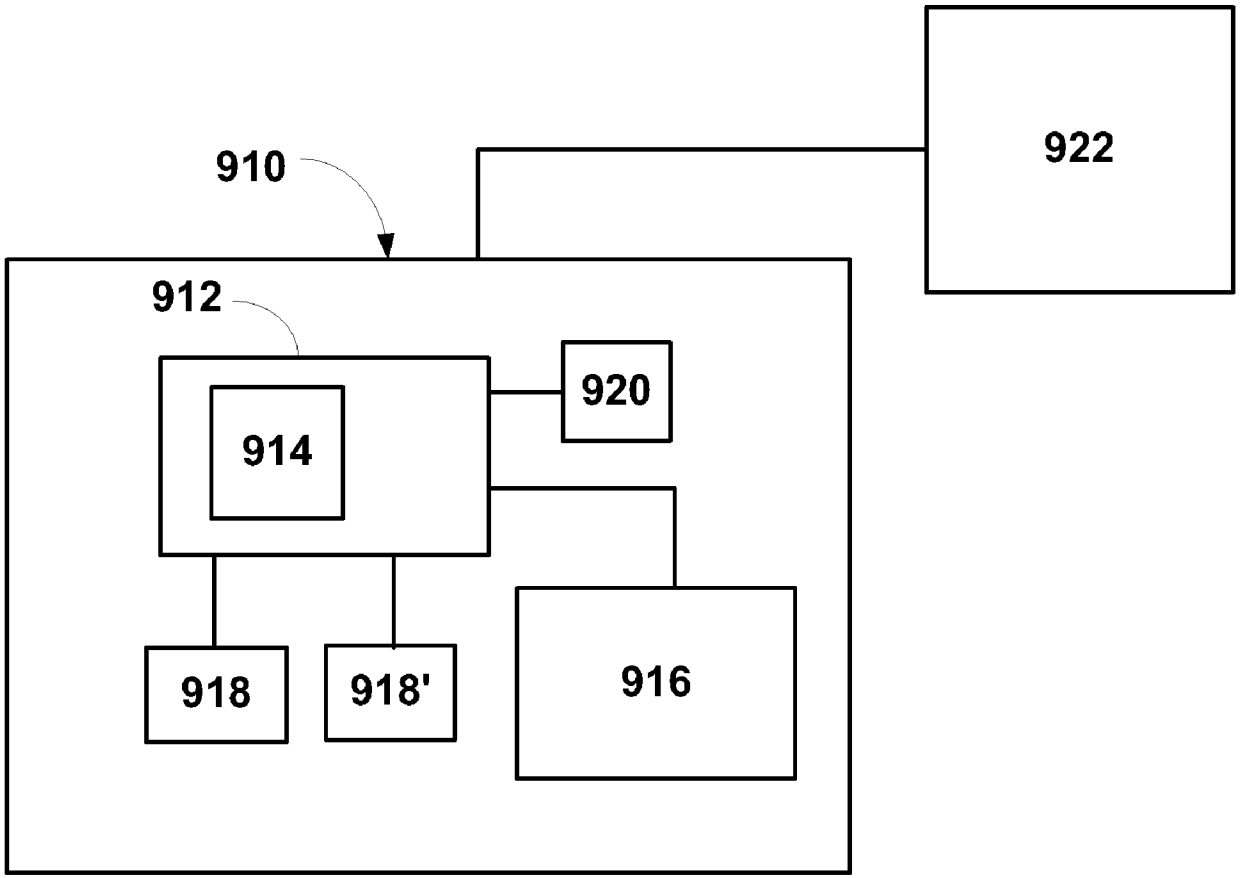
FIG. 2 is an illustration of an image forming device containing a processor and a storage device therein.

In an exemplary embodiment, the algorithm analysis performed herein may be in accord with the aforementioned U.S. patent application Ser. No. 11/771,121, accomplished by, as illustrated in FIG. 2, a processor 912 found in a controller 914 of an image-forming device 910. The controller 914 may communicate with and receive signals/data from the storage devices on a cartridge 916 and a toner patch sensor 918. As noted hereinbefore, the toner patch sensor 918 may be a single unit, or a dual unit including a second toner patch sensor 918'. The data received may be referenced to a series of lookup tables provided in a memory 920 located in the image forming device 910, the toner cartridge 916 for use with the image-forming device 910, or in a computer 922 which may be in communication with the image-forming device 910. The analysis provided herein in combination with the given toner formulations may therefore be utilized to adjust an operating parameter of the image-forming device, such as photoconductor or developer roll bias, etc., based on the a comparison of the calculated Ratio (A:B) to the predetermined Ratio (A:B).

Using the above equations, the operating conditions of the printer, such as photoconductor charge, laser discharge intensity, or developer roller bias, may then be adjusted according to the detected toner layer density and/or thickness in order to provide the necessary proportions of toner to achieve a desired color.

Image forming media (e.g. toner) containing a binder, which may be understood as a polymeric type resin, are used in the present invention, and may be in accord with the toner disclosed in copending U.S. patent application Ser. No. 11/871,245, whose teachings are incorporated by reference. Such polymeric resin may therefore include, e.g., those polymers that are typically used in toners to provide appropriate fusing characteristics when used in an electrophotographic type printer. For example, the binder may comprise thermoplastic type polymers such as styrene or styrene-acrylate type polymers, polyester polymers, etc. The image forming media herein may therefore include toner and the image forming apparatus may include an electrophotographic device, copier, fax, all-in-one device or multi-functional device. Toner for electrophotographic (e.g. laser) printing may be prepared according to a number of techniques.

According to a first technique, a so-called "conventional toner" may be prepared from a toner resin that may be melt mixed with pigment and other additives. The melt mixed toner formulation may be crushed, pulverized, milled, and classified to provide fine particles of a desired size. Additives may be incorporated onto the toner particle surfaces as an extra particulate additive. According to another technique, "chemically produced toner" may be prepared in which toner particles may be prepared by chemical processes such as aggregation or polymerization rather than being abraded from much larger size materials by physical processes.

The infrared transmissive pigments may also be understood as reference to a pigment that does not compromise the ability of a toner patch sensor to provide information regarding the amount of unfused toner on a given surface. Such transparency may therefore allow the incident IR light to diffuse to underlying toner layers and reflect, thereby increasing the relative amount of reflected light with relatively thicker toner layers. Overall, this may then produce acceptable toner patch sensor sensitivity at selected target mass. Accordingly, the toner formulations used herein provide a toner that may still be responsive to a toner patch sensor. Such improved toner layer thickness control may therefore lead to improved ability to accurately and repeatedly produce colors of an image developed on a recording media, e.g. a printed image. Reference to pigment herein is intended to be inclusive of any composition that may independently provide a given color. This technique could conceivably be applied to a black toner made without using any carbon black, or with no more than 0.5% carbon black.

Image forming media (e.g., toner) to be measured for density or thickness may be placed on a control surface that may include a transport or transfer belt 130. The toner patches, i.e., the solid and grayscale toner test patterns, may be printed on the control surface 130, and the control surface 130 may be impinged with light from an infrared light source 152, 152'. At least a portion of the infrared light may be reflected by the toner patches and collected by an infrared detector 154, 154'. The toner layer density and/or thickness may be determined from the reflected signal strength of the toner patches, e.g., by comparison to the reflected signal strength from the test surface itself and/or in comparison to the reflected signal strength of one or more grayscale toner test patterns. Toner layer density, as understood herein, is reference to a given mass (e.g. grams) of toner per unit area (e.g. $cm^2$). The operating conditions of the printer 100 may then be adjusted according to the detected toner layer density and/or thickness in order to provide the necessary proportions of toner to achieve a desired color.

Figure 4:
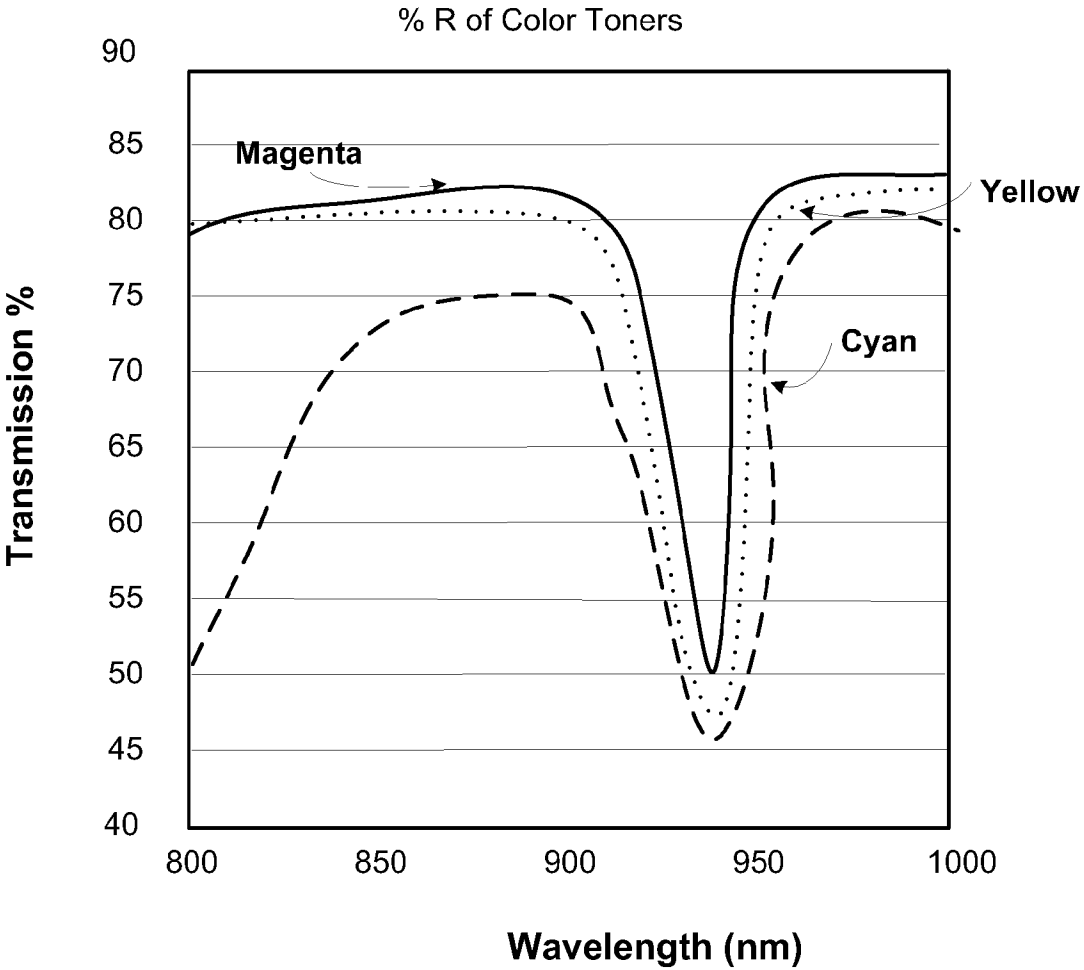
FIG. 4 is a graph illustrating the reflectivity of an exemplary toner in the infrared spectrum used in the present invention.

It may be therefore appreciated that a conventional black IR absorbing colorant, e.g., carbon black, will generally absorb light in the infrared range of the spectrum, which may therefore produce a relatively weak reflected infrared signal for the toner position sensor 150. The weak reflected infrared signal may then make it relatively difficult reliably to determine a toner layer thickness of a black toner in a system utilizing infrared reflectivity. More specifically, as the toner patch sensors emit and detect light at about 750 nm-1000 nm, and more particularly, 900 nm-1000 nm, the relatively strong absorption of light by the carbon black at such wavelengths can make toner particles containing carbon black relatively opaque and the toner patch sensor reflection signal may therefore indicate a zero slope (no sensitivity) after more than one monolayer of toner is laid down. This may be particularly problematic in those situations where the desired target mass/unit area (M/A) is 1-3 toner monolayers. It will thus be appreciated that calibration in accord with the present invention is preferably performed with the toner colors cyan, magenta, and yellow, which, as discussed more fully hereinbelow in connection with FIG. 4, are more reflective of the infrared spectrum around 940 nm than the black toner as discussed above. It will be further appreciated that a black toner with an infrared reflectivity comparable to the cyan, magenta, and yellow toners of FIG. 4 could also be used to calibrate the image forming device 100 in accord with the present invention.

A given toner formulation may generally include a resin and a colorant (e.g. pigment) as well as various additives. It should be noted that reference herein to the term colorant is intended to be inclusive of any composition that provides a given color. In that regard, it is intended to include either a pigment, which may typically be solid particulate, as well as a dye. The dyes would preferably be soluble in the resin and dissolved into it during the manufacturing process. The resin itself may generally be relatively transparent to infrared light. However, various additives in the formulation, including some colorants, may reduce the transparency, i.e., the additives may cause absorption of at least a portion of incident infrared light.

It should therefore be appreciated that while the control surface may absorb a substantial portion of the infrared light emitted from the sensor at a given wavelength, most color toner formulations, i.e., cyan, magenta, or yellow formulations, may be relatively weak absorbers and may thus reflect a significant/substantial portion of the incident infrared light emitted from the sensor at the given wavelength. Such a relatively reflective toner may reflect 25% or more of the incident infrared light of a given wavelength emitted by the sensor when the toner is at saturation, including all values and increments in the range of about 25 to 99% of the incident light.

In an exemplary embodiment of performing toner patch measurements, the toner formulations may be deposited in a test pattern or in a series of patches on a control surface. The toners may be deposited directly onto the control surface in a first patch. Substantially the same amount, i.e., within +/−5% by weight, of the toner may also be deposited onto another patch on the control surface or onto other, previously deposited toner patches to provide a plurality of toner patches, all as desired.

As previously noted, the signal indicating the reflectivity of the toner patches may be measured by an optical detector which may then provide a voltage or other signal correlating to the amount of reflectivity of the toner, i.e., the greater the reflectivity, the higher the voltage, or vice versa.

In an exemplary embodiment, the calibration performed herein may be accomplished by a processor 912 found in the controller 914 of the image forming device 100. The controller may communicate with and receive signals/data from the storage devices on the cartridge and the toner patch sensor 918, 918'. The data received may be referenced to a series of lookup tables provided in a memory 920 located in the image forming device 100, a toner cartridge 916 for use with the image forming device 100 or in a computer which may be in communication with the image forming device 100.

Figure 3:
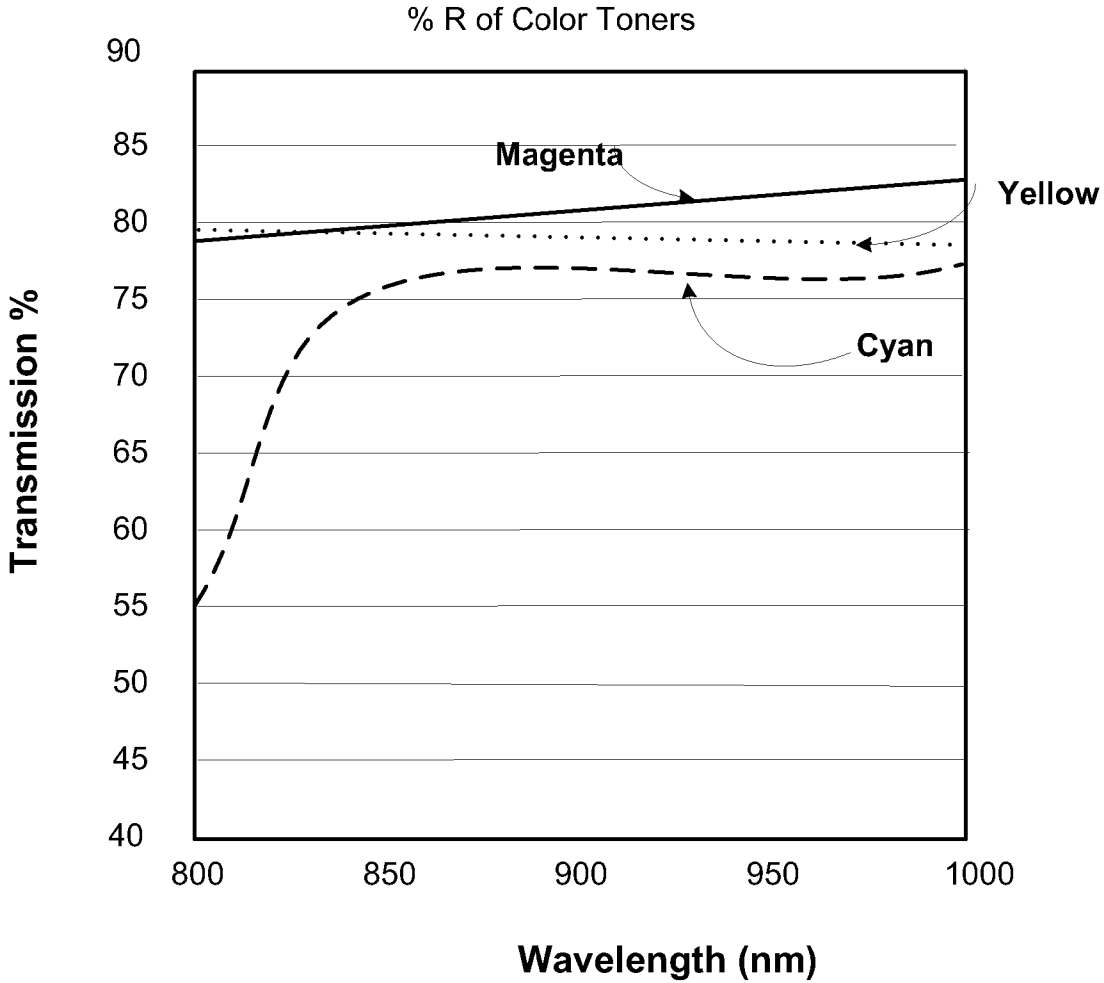
Figure 3 Prior Art
FIG. 3 is a graph illustrating the reflectivity of prior art toners in the infrared spectrum.

FIG. 3 illustrates the bulk reflectance of unfused cyan, magenta, and yellow toner powders in the infrared spectrum. It will be appreciated from FIG. 3 that the reflectivity of the magenta and yellow toners is relatively constant from 800 nm to 1000 nm, and is, in the illustrative embodiment, around 80%. The cyan toner is relatively more absorptive below about 850 nm, but is relatively constant, about 80%, above that frequency.

A pigment or dye may be added to the cyan, magenta, and yellow toners to increase the absorption properties around 940 nm. The increased absorption may be localized, producing a "notch" in the optical spectrum, as illustrated in connection with FIG. 4, wherein the bulk powder reflectance of the cyan, magenta, and yellow toners drops to around 45% to 50% at 940 nm. It will be appreciated that the increased absorption of the cyan, magenta, and yellow toners may also extend out substantially into the infrared spectrum when the frequency of the second infrared emitted wavelength (for example, 940 nm) is greater than the frequency of the first infrared emitted wavelength (for example, 880 nm).

Figure 5:
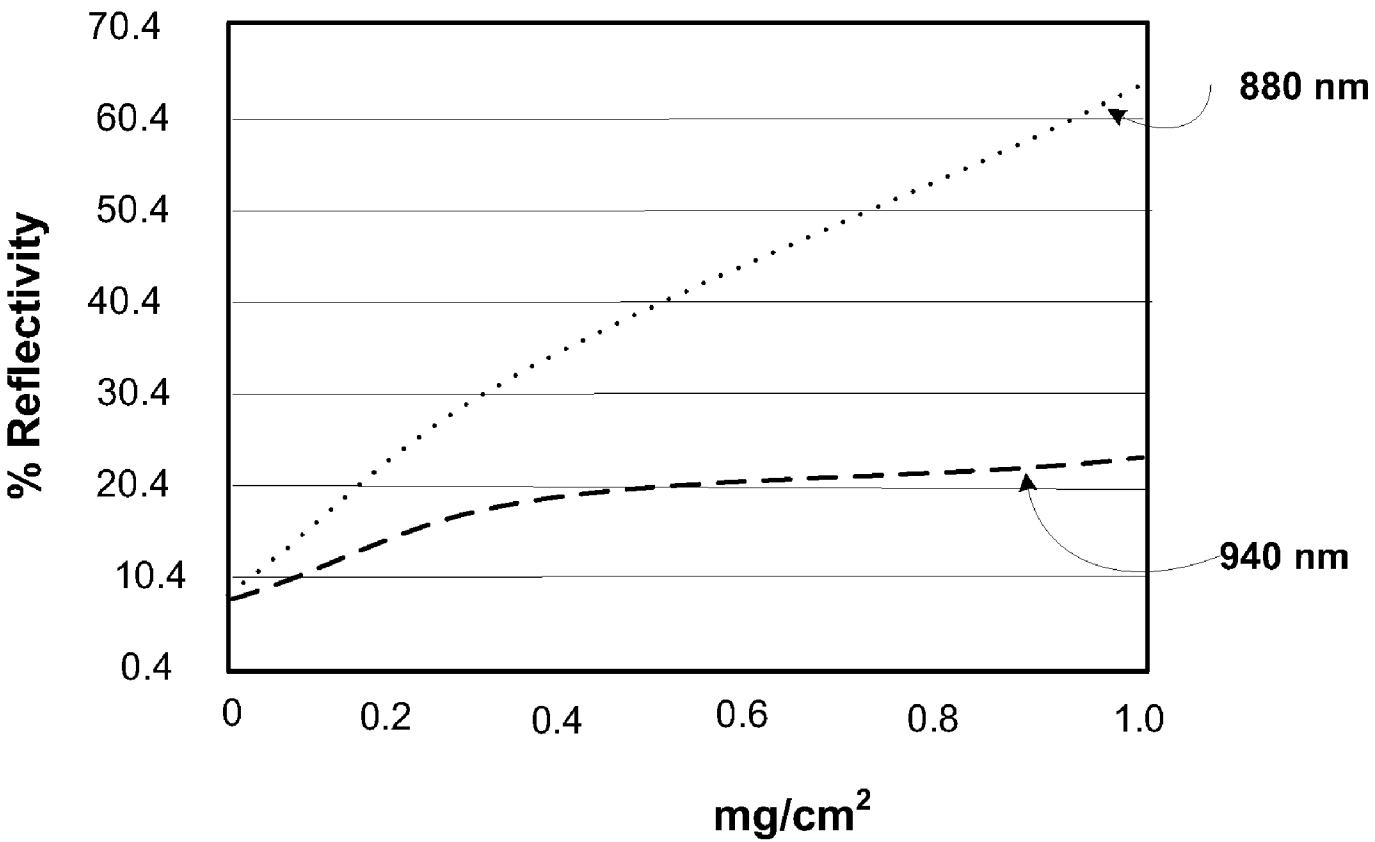
FIG. 5 is a graph illustrating toner layer reflectivity versus mass coverage of an exemplary toner in the infrared spectrum used in the present invention.

FIG. 5 illustrates toner layer reflectivity versus mass coverage of an exemplary toner in the infrared spectrum. As depicted in the figure, the higher absorption of the toner near 940 nm produces a reduced reflectivity as compared to the reflectivity of the toner near 880 nm. It will be appreciated that the reflectivity of toner patches at the 880 nm wavelength will be substantially different than the reflectivity of those same toner patches at the 940 nm wavelength, and that this difference is considered to be a desirable condition.

Figure 6:
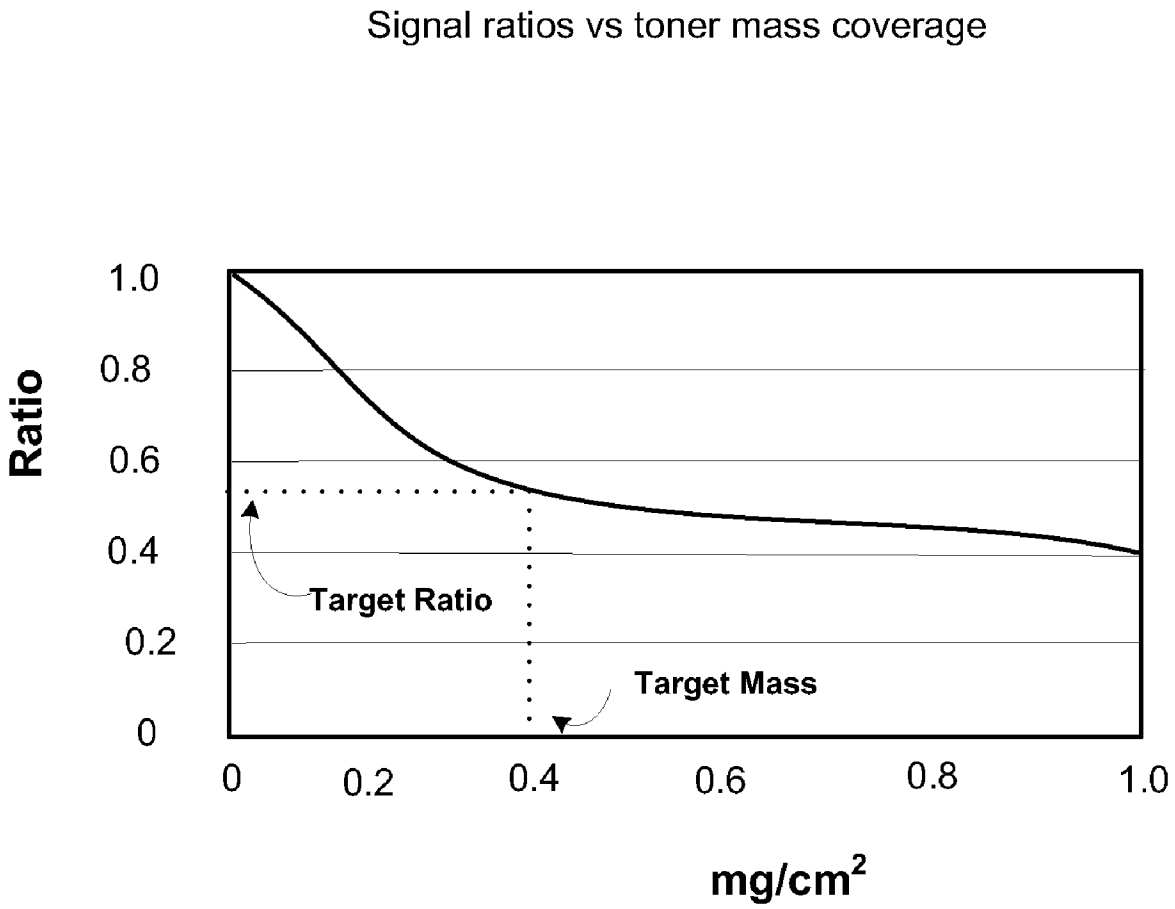
FIG. 6 is a graph illustrating signal ratios versus toner mass coverage in a toner used in the present invention.

FIG. 6 illustrates signal ratios versus toner mass coverage in a toner used in the present invention. As discussed hereinbefore in connection with FIG. 2, the ratios of the signals from the toner patch sensor 150 obtained from the two measurements of reflected infrared light at 880 nm and 940 nm are calculated and used to select operating conditions in the image forming device 100 that will produce the desired toner layer thickness or density. The ratio of the signals derived from the measurements of the reflected infrared light decreases monotonically as the mass per unit area of the toner test patches increase. The image forming device 100 monitors and computes the ratios of the signals reflected at 880 nm and 940 nm for a series of test patches formed under different image conditions, and then selects an image development condition for the image forming device 100 that produces the target signal ratio, whereby the image forming device 100 achieves the desired target toner mass per unit area. It has been observed that the calibration of the image forming device 100 employing two measurements of reflected infrared light produces superior accuracy as compared to the calibration employing a single infrared spectrum.

The teachings of U.S. Pat. No. 6,560,418, also assigned to Lexmark International, Inc., and incorporated herein by reference, would be particularly useful in employing a practical application of the present invention. The patent discloses a method of setting laser power and developer bias in a multicolor electrophotographic machine. According to the disclosure, single and multi-layer toner patches and belt measurements may be used to set laser power and developer bias according to the formula:

$$R_{patch}=R_{belt}*e^{(-K*m)}+R_{toner}*(1-e^{(-K*m)})$$

where K is the hiding power coefficient of the toner, m is the toner mass per unit area, $R_{belt}$ is the reflectivity of the intermediate belt, and $R_{toner}$ is the reflectivity of an infinitely thick toner layer. It will be appreciated that the value of K is a function of the pigment or dye level, and correspondingly determines the saturation layer thickness. It will be further appreciated that different values for K will produce different systems for utilizing the data.

It will also be appreciated from the above discussion that the disclosed method, system and apparatus may be extended to additional spectra wavelengths with associated notch absorbing pigments or dyes added to provide different saturation layer thicknesses. It will also be appreciated that notch absorbing pigments or dyes may be used to identify specific toners. A ratio could be calculated to identify a specific toner with a zero notch pigment, for example, or 25%, 50%, 75%, and 100%, where 100% would represent toner saturation. Since pigments containing notch absorbing pigments do not affect the color of the toners, such additives could be used to identify special toners.

It will also be appreciated by persons of ordinary skill in the art that the method, system and apparatus of the present invention may also be used with printed toner by using an external optical device providing a function similar to the toner patch sensor 150.

It should now also be clear that embodiments of the methods described above may be implemented in a computer program that may be stored on a storage medium having instructions to program a system to perform the methods. The storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions. Other embodiments may be implemented as software modules executed by a programmable control device.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A method for calibrating an image forming device having a toner patch sensor that emits and detects light in the infrared spectrum, comprising:

depositing a toner patch onto a control surface;

emitting light at a plurality of wavelengths in the infrared spectrum with said toner patch sensor onto said toner patch, said toner patch reflecting said light at said plurality of wavelengths;

detecting incident light reflected from said toner patch at said plurality of wavelengths from the emitted light and measuring signals indicative of reflectivities of said toner patch at each of said plurality of wavelengths; and adjusting an operating parameter of said image forming device based upon said reflectivities of said toner patch at each of said plurality of wavelengths by comparing said reflectivities at said plurality of wavelengths with each other.

2. The method of claim 1, wherein said depositing said toner patch includes depositing said toner patch to reflect light in first and second wavelengths.

3. The method of claim 2, wherein said emitting light includes emitting light at said first and second wavelengths.

4. The method of claim 3, wherein said emitting light includes emitting said light at said first and second wavelengths with a single emitter.

5. The method of claim 3, wherein said emitting light includes emitting said light at said first wavelength with a first emitter, and emitting said light at said second wavelength with a second emitter.

6. The method of claim 1, wherein said detecting said incident light reflected from said toner patch includes detecting said incident light with a single sensor.

7. The method of claim 1, wherein said detecting said incident light reflected from said toner patch includes detecting said incident light with a plurality of sensors.

8. The method of claim 1, wherein said emitting light includes emitting said light at about 880 nm and at about 940 nm.

9. The method of claim 1, wherein said adjusting said operating parameter includes identifying a type of toner deposited in said toner patch.

10. The method of claim 1, wherein said comparing comprises determining a ratio of said reflectivity of said toner patch at a first wavelength and said reflectivity of said toner patch at a second wavelength such that said adjusting is based upon said ratio.

11. The method of claim 1, wherein depositing a toner patch comprises depositing a plurality of toner patches, wherein said emitting light and said detecting the amount of incident light are performed for each toner patch, and wherein said comparing comprises determining a ratio of said reflectivity of a first of said toner patches at a first wavelength and said reflectivity of said first toner patch at a second wavelength, and determining a ratio of said reflectivity of a second of said toner patches at said first wavelength and said reflectivity of said second toner patch at said second wavelength such that said adjusting is based upon said ratios.

12. A system for calibrating an image forming device, comprising:

a light source for illuminating a toner patch deposited on a control surface at a first predetermined frequency and a second predetermined frequency, said toner patch having a first reflectivity at said first predetermined frequency and a second reflectivity at said second predetermined frequency;

a detector for receiving light reflected from said toner patch, said detector providing signals indicative of said first and second reflectivities of said toner patch at each of said first and second predetermined frequencies, respectively; and a controller, including a processor in communication with said detector, wherein said processor receives said signals from said detector indicative of said first and second reflectivities of said toner patch at said first and second predetermined frequencies, and adjusts an operating parameter of said image forming device based on said first and second reflectivities of said toner patch by comparing said reflectivities at said plurality of wavelengths with each other.

13. The system of claim 12, wherein said light source includes first and second light emitters, said first emitter emitting light at said first predetermined frequency, and said second emitter emitting light at said second predetermined frequency.

14. The system of claim 12, wherein said detector includes first and second light detectors, said first light detector detecting light at said first predetermined frequency indicative of the first reflectivity of said toner patch at said first predetermined frequency, and said second light detector detecting light at said second predetermined frequency indicative of the second reflectivity of said toner patch at said second predetermined frequency.

15. The system of claim 12, wherein said light source includes a single light emitter emitting light at said first and second predetermined frequencies.

16. The system of claim 12, wherein said detector includes a single light detector detecting light at said first and second predetermined frequencies indicative of the first and second reflectivities of said toner patch at said first and second predetermined frequencies.

17. The system of claim 12, wherein said controller identifies the type of toner in said toner patch using said first and second reflectivities of said toner patch.

18. The system of claim 12, wherein said processor determines a ratio of said reflectivity of said toner patch at a first wavelength and said reflectivity of said toner patch at a second wavelength such that said adjusting is based upon said ratio.

19. The system of claim 12, wherein said processor determines a ratio of said reflectivity of a first toner patch at a first wavelength and said reflectivity of said first toner patch at a second wavelength, and determines a ratio of said reflectivity of a second toner patch at said first wavelength and said reflectivity of said second toner patch at said second wavelength such that said adjusting is based upon said ratios.

20. An apparatus in an image forming device, comprising:

a light source for illuminating a toner patch deposited on a control surface at a plurality of predetermined wavelengths;

a detector for receiving reflected light from said toner patch, said detector providing signals indicative of reflectivities of said toner patch at each of said plurality of predetermined wavelengths; and a controller, including a processor in communication with said detector, wherein said processor receives said signals from said detector indicative of the reflectivities of said toner patch at each of said plurality of predetermined wavelengths, and adjusts an operating parameter of said image forming device based on said reflectivities of said toner patch at each of said plurality of predetermined wavelengths by comparing said reflectivities at said plurality of wavelengths with each other.

21. The apparatus of claim 20, wherein said light source includes first and second light emitters, said first emitter emitting light at a first predetermined frequency, and said second emitter emitting light at a second predetermined frequency.

22. The apparatus of claim 21, wherein said detector includes first and second light detectors, said first light detector detecting light at said first predetermined frequency indicative of a first reflectivity of said toner patch at said first predetermined frequency, and said second light detector detecting light at said second predetermined frequency indicative of the reflectivity of said toner patch at said second predetermined frequency.

23. The apparatus of claim 20, wherein said light source includes a single light emitter emitting light at first and second predetermined frequencies.

24. The apparatus of claim 20, wherein said detector includes first and second light detectors, said first light detector detecting light at a first predetermined frequency indicative of a first reflectivity of said toner patch at said first predetermined frequency, and said second light detector detecting light at a second predetermined frequency indicative of second reflectivity of said toner patch at said second predetermined frequency.

25. The apparatus of claim 20, wherein said detector includes a single light detector detecting light at first and second predetermined frequencies indicative of first and second reflectivities of said toner patch at said first and second predetermined frequencies.

26. The system of claim 20, wherein said controller identifies the type of toner in said toner patch based on said reflectivities of said toner patch at each of said plurality of predetermined wavelengths.

27. The apparatus of claim 20, wherein said processor determines a ratio of said reflectivity of said toner patch at a first wavelength and said reflectivity of said toner patch at a second wavelength such that said adjusting is based upon said ratio.

28. The apparatus of claim 20, wherein said processor determines a ratio of said reflectivity of a first toner patch at a first wavelength and said reflectivity of said first toner patch at a second wavelength, and determines a ratio of said reflectivity of a second toner patch at said first wavelength and said reflectivity of said second toner patch at said second wavelength, such that said adjusting is based upon said ratios.

* * * * *